US006471012B2

(12) United States Patent
Faletto

(10) Patent No.: US 6,471,012 B2
(45) Date of Patent: Oct. 29, 2002

(54) PULLEY SYSTEM FOR A TRACTION SHEAVE ELEVATOR

(75) Inventor: Luciano Faletto, Arese (IT)

(73) Assignee: Kone Corporation (FI)

( * ) Notice: Subject to any disclaimer, the term of this patent is extended or adjusted under 35 U.S.C. 154(b) by 0 days.

(21) Appl. No.: 09/849,598

(22) Filed: May 7, 2001

(65) Prior Publication Data

US 2002/0000348 A1 Jan. 3, 2002

Related U.S. Application Data

(63) Continuation of application No. PCT/FI99/00913, filed on Nov. 2, 1999.

(30) Foreign Application Priority Data

Nov. 5, 1998 (FI) ..... 982403

(51) Int. Cl.[7] ..... B66B 11/08
(52) U.S. Cl. ..... 187/256; 187/406; 187/266
(58) Field of Search ..... 187/277, 254, 187/250, 251, 256, 261, 262, 266, 406, 411

(56) References Cited

U.S. PATENT DOCUMENTS

| | | | | | |
|---|---|---|---|---|---|
| 373,144 | A | * | 11/1887 | Wallmann | 187/266 |
| 1,911,834 | A | * | 5/1933 | Lindquist | 187/266 |
| 2,537,075 | A | * | 1/1951 | Margles | 187/266 |
| 3,101,130 | A | | 8/1963 | Bianca | |
| 5,878,847 | A | * | 3/1999 | Mustalahti et al. | 187/406 |
| 5,899,300 | A | * | 5/1999 | Miller et al. | 187/256 |
| 6,302,239 | B1 | * | 10/2001 | Honda | 187/254 |
| 2002/0000346 | A1 | | 1/2002 | Baranda et al. | |

FOREIGN PATENT DOCUMENTS

| | | | | |
|---|---|---|---|---|
| DE | 1032496 | | 6/1958 | |
| DE | 297 04 886 | | 6/1997 | |
| EP | 0 588 364 A1 | | 3/1994 | |
| EP | 0 631 967 A 2 | | 1/1995 | |
| JP | 2000-203775 | * | 7/2000 | |
| US | 2001/009211 A1 | * | 7/2001 | 187/266 |
| WO | 96/09978 | | 4/1996 | |
| WO | 99/43595 | | 9/1999 | |

* cited by examiner

*Primary Examiner*—Jonathan Salata
(74) *Attorney, Agent, or Firm*—Venable; Robert Kinberg

(57) ABSTRACT

The invention relates to a traction sheave elevator. The elevator car has been arranged to move along guide track in an elevator shaft. The counterweight has been arranged to move along guide track in the elevator shaft. Both ends of rope are attached to a fixed overhead structure. The elevator car and the counterweight are supported by the rope. The rope is passed via a number of rope pulleys, one of which is the traction sheave while the others are diverting pulleys. Rope pulleys are connected to the counterweight, to the fixed overhead structure in the upper part of the elevator shaft and to the elevator car. The elevator car is provided with a first pair of car rope pulleys placed at a distance from each other. The traction motor has been arranged to drive one of the rope pulleys, which is the traction sheave. Connected to the elevator car is a second pair of car rope pulleys, in which the car rope pulleys are at a distance from each other. An auxiliary rope pulley is connected to the fixed overhead structure. The rope is passed from a car rope pulley of the first pair of car rope pulleys via the auxiliary rope pulley mounted on the fixed overhead structure to a car rope pulley, of the second pair of car rope pulleys.

10 Claims, 2 Drawing Sheets

PULLEY SYSTEM FOR A TRACTION SHEAVE ELEVATOR

CROSS-REFERENCE TO RELATED CASES

This is a continuation of commonly owned, copending PCT application No. PCT/FI99/00913 filed Nov. 2, 1999, which designates the United States and which claims priority of application Ser. No. 982,403 filed in Finland on Nov. 5, 1998, the priority of which is claimed herein.

Each and every U.S. and foreign patent and patent application, inclusive of the above PCT and Finish patent applications, identified in the specification of the present application is to be considered as being incorporated herein by reference.

BACKGROUND OF THE INVENTION

1. Field of the Invention

The present invention relates to a traction sheave elevator. More specifically, the present invention relates to distributing the load of an elevator car structure via rope suspension.

2. Description of the Related Art

In the prior art, specifications DE-U-29704886 and EP-A2-0631967 present elevators in which the elevator car and the counterweight have been arranged to move along a guide track in an elevator shaft. Both ends of the elevator rope are attached to a fixed structure and the elevator car and counterweight are carried by the rope. The rope is passed over rope pulleys. The traction sheave is driven by a fraction motor. Rope pulleys are mounted on the counterweight, on a fixed overhead structure and on the elevator car. The basal structures of the elevator car are provided with a pair of rope pulleys and the rope is passed via this pair of pulleys so that it goes once under the car and the elevator car is thus supported by the rope.

Since the aim is to place the elevator car in a centric fashion in the car frame or an equivalent supporting structure and to place the car guides leaning against the guide rail as close as possible to a plane intersecting the center line or center of gravity of the elevator car, it is difficult to achieve a centric supporting effect on the car or car frame of rope suspension with ropes passing under the elevator car. When the rope runs via a single pair of rope pulleys attached to the elevator car, the load is applied via the rope pulley suspension to only one line passing under the car. Furthermore, suspending the car on a single pair of rope pulleys, especially in the case of freight elevators used to transport heavy loads, leads to a necessity to use thick ropes and rope pulleys with a large diameter.

SUMMARY OF THE INVENTION

The object of the present invention is to eliminate the drawback's described above.

A specific object of the present invention is to provide a traction sheave elevator in which the load applied via rope suspension can be distributed over a larger area in the elevator car structure than before. Another object of the invention is to implement a rope-driven freight elevator without machine room to replace conventional hydraulic freight elevators. A further object of the invention is to disclose an arrangement that, enables a lighter elevator car structure to be achieved.

In one embodiment, the traction sheave elevator of the invention comprises: an elevator car adapted to move along a first guide track in an elevator shaft; a counterweight, adapted to move along a second guide track in the elevator shaft; a rope, having first and second ends, wherein both ends are attached to a fixed overhead structure in upper part of the elevator shaft, the elevator car and the counterweight being carried by said rope; a plurality of rope pulleys adapted to receive the rope and connected to the counterweight, a fixed overhead structure in the elevator shaft, and the elevator car, wherein the plurality of rope pulleys comprises: a traction sheave, a first pair of car rope pulleys mounted on the elevator car at a first distance from each other, a second pair of car rope pulleys mounted on the elevator car at a second distance from each other, and an auxiliary rope pulley connected to the fixed overhead structure, wherein a rope is passed from one of the car rope pulleys of the first pair of car rope pulleys to one of the car rope pulleys of the second pair of car rope pulleys by way of the auxiliary rope pulley; and a traction motor arranged to drive the traction sheave.

According to the invention, the traction sheave elevator comprises a second pair of car rope pulleys connected to the elevator car, in which the car rope pulleys are placed at a distance from each other, and an auxiliary rope pulley mounted on a fixed overhead structure in the building. The rope is passed from a car rope pulley in a first pair of car rope pulleys to the auxiliary rope pulley mounted on a fixed overhead structure and further to a car rope pulley in the second pair of car rope pulleys.

The invention has the advantage that as the elevator car is provided with at least four pulleys placed at a distance from each other over which the rope passes twice, going over the auxiliary rope pulley in between, the load is distributed over a large area in the elevator car. The elevator car can be built using a lighter and less rigid structure than in earlier elevators. Moreover, the invention discloses an elevator capable of hoisting relatively heavy loads using a motor that has a relatively low power rating and is therefore small.

In an embodiment of the elevator, the second pair of car rope pulleys is at a distance from the first pair of car rope pulleys so that the rope portion passing via the first pair of car rope pulleys is substantially parallel to the rope portion passing via the second pair of car rope pulleys. The car rope pulleys are disposed in a rectangular configuration.

In an embodiment of the elevator, the first pair of car rope pulleys and the second pair of car rope pulleys are symmetrically disposed on either side of the centre line of the elevator car, thus producing a balanced structure.

In an embodiment of the elevator, the counterweight is provided with a first counterweight rope pulley and a second counterweight rope pulley. A second auxiliary rope pulley is mounted on a fixed overhead structure directly above the counterweight. The rope is passed from the first counterweight rope pulley to the second counterweight rope pulley via the second auxiliary rope pulley.

In an embodiment of the elevator, the first pair of car rope pulleys and the second pair of car rope pulleys are disposed under the elevator car, the rope being thus passed by a route below the elevator car.

In an embodiment of the elevator, the first pair of car rope pulleys and the second pair of car rope pulleys are disposed on top of the elevator car, in which case the rope is passed by a route above the elevator car.

In an embodiment of the elevator, the rope is passed from a fixed overhead structure, to which its first end is attached, to the first counterweight rope pulley. From the first counterweight rope pulley, the rope is passed to the second auxiliary rope pulley. From the second auxiliary rope pulley, the rope is passed to the second counterweight rope pulley. From the second counterweight rope pulley, the rope is passed to the pulley on the traction motor, i.e. to the traction sheave. From the traction sheave, the rope is passed to the car rope pulleys of the first pair of car rope pulleys. From a pulley in the first pair of car rope pulleys, the rope is passed to the first auxiliary rope pulley. From the first auxiliary rope pulley, the rope is passed to the car rope pulleys of the second pair of car rope pulleys. From a car rope pulley in the second pair of car rope pulleys, the rope is passed to a fixed overhead structure, to which the second end of the rope is attached.

In an embodiment of the elevator, in respect of the rope pulleys of the second pair of car rope pulleys, the speed ratio between the elevator car and the counterweight is 1:1.

In an embodiment of the elevator, the first end of the rope, the second end of the rope, the first auxiliary rope pulley, the second auxiliary rope pulley and/or the traction motor are mounted on guide rails. The guide rails are preferably planted on the bottom of the elevator shaft to pass the vertical forces down to the groundwork. Passing the vertical forces via the guide rails down to the groundwork provides an advantage as it makes the elevator independent of the wall structures of the building, which is a great advantage especially in feeble-constructed buildings, such as industrial sheds.

In the following, the invention will be described in detail by the aid of a few examples of its embodiments by referring to the drawings.

DETAILED DESCRIPTION OF THE PREFERRED EMBODIMENTS

Figure 1:
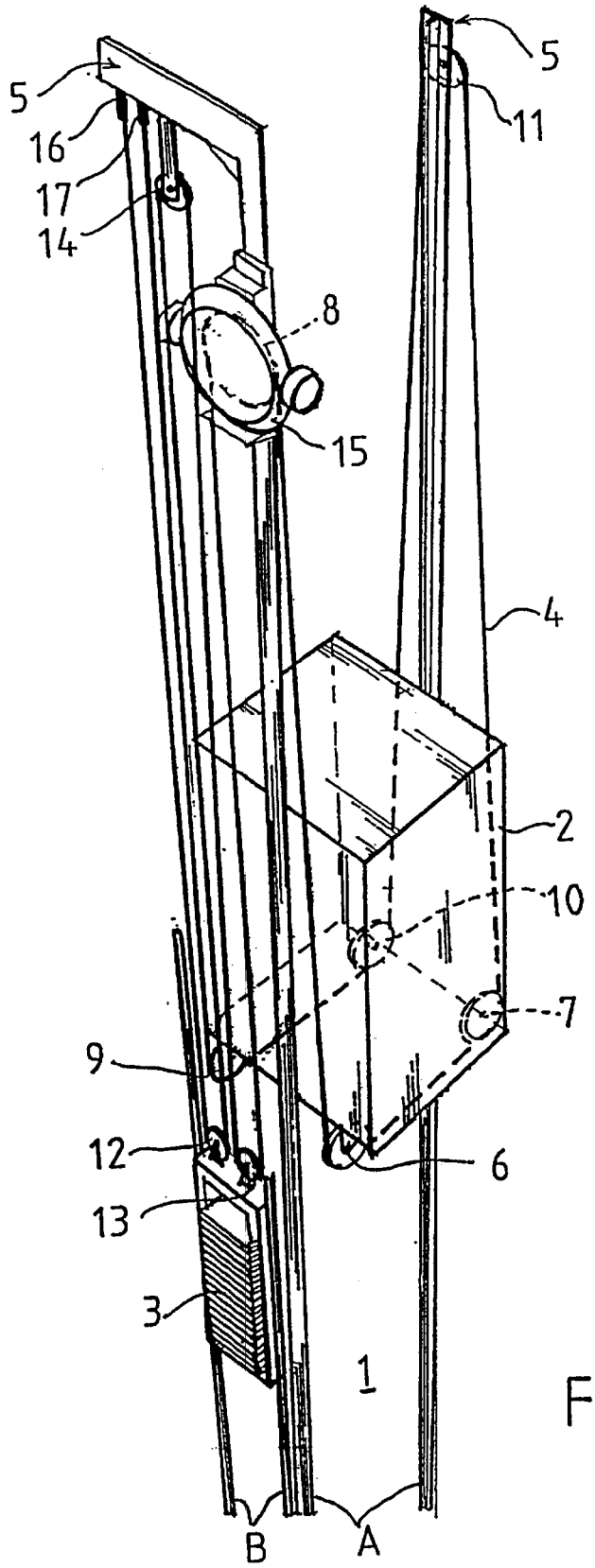
FIG. 1 presents a diagram representing a first embodiment of the traction sheave elevator of the invention, seen in perspective view obliquely from above.

FIG. 1 shows a so-called traction sheave elevator, which can be used as a low-speed freight elevator. The elevator car 2 has been arranged to move along guide rails A in the elevator shaft 1. Likewise, the counterweight 3 has been arranged to move along its own guide rails B in the elevator shaft. Both the elevator car 2 and the counterweight are carried by the same rope 4. For the sake of clarity, the figures show only one rope, but of course the rope may comprise a rope bundle or a number of adjacent ropes, as is customary in elevator technology. Similarly, the figure shows simple grooved rope pulleys, but it is clear that when several adjacent ropes are used, the pulleys must have a corresponding number of grooves or several pulleys are used side by side. The diverting pulleys may have grooves of semicircular cross-section and the traction sheave may have undercut grooves to increase friction.

As shown in FIG. 1, both ends 16 and 17 of the rope 4 are anchored in a fixed overhead structure 5 in the building. The rope 4 is passed over a number of rope pulleys 6–14. The counterweight rope pulleys 12 and 13 are connected to the counterweight 3. The first auxiliary rope pulley 11 and the second auxiliary rope pulley 14 are connected to the fixed overhead structure 5. Car rope pulleys 6, 7, 9 and 10 are connected to the elevator car 2. The traction motor 15 has been arranged to drive one of the rope pulleys 8. The fixed overhead structure 5 to which the ends 16 and 17 of the rope 4 and the auxiliary rope pulleys 11 and 14 are attached may be e.g. the ceiling of the elevator shaft or e.g. guide rail A and/or B. In the embodiment illustrated by FIG. 1, the ends 16 and 17 of the rope 4 and the auxiliary rope pulleys 11 and 14 are fixed to the guide rails, which is an advantageous arrangement because it makes the elevator independent of the wall structures of the building and allows the use of feeble constructed walls. Large vertical forces can be transmitted down to the groundwork while lateral forces are transmitted via the guide rail fixtures to the walls of the elevator shaft or to similar structures.

The traction motor 15 is a synchronous motor with permanent magnets, and the drive pulley 8 is integrated with its rotor. The motor is mounted in the elevator shaft 1 and attached to the upper part of a guide rail A.

The elevator car 2 is provided with two pairs of car rope pulleys, a first pair of car rope pulleys 6, 7, in which the car rope pulleys 6 and 7 are placed at a distance from each other near the opposite lower edges of the bottom of the elevator car, and a second pair of car rope pulleys 9, 10, in which the car rope pulleys 9 and 10 are correspondingly placed at a distance from each other near the opposite lower edges of the bottom of the elevator car. The first pair of car rope pulleys 6, 7 and the second pair of car rope pulleys 9, 10 are substantially symmetrically disposed on either side of the center line of the elevator car 2, thus providing a stable suspension with widely spaced supporting points, distributing the load over a large area in the elevator car.

The rope 4 is passed from a car rope pulley 7 of the first pair of car rope pulleys 6, 7 via auxiliary rope pulley 11 in the fixed overhead structure 5 to a car rope pulley 10 of the second pair of car rope pulleys 9, 10 on the elevator car 2. The second pair of car rope pulleys 9, 10 is at a distance from the first pair of car rope pulleys 6, 7 so that the rope portion running via the first pair of car rope pulleys 6, 7 under the elevator car 2 is substantially parallel with the rope portion running via the second pair of car rope pulleys 9, 10 under the elevator car 2. The running direction of the rope 4 between the car rope pulleys 6 and 7 in the first pair of car rope pulleys is opposite to the running direction of the rope portion between the car rope pulleys 9 and 10 in the second pair of car rope pulleys.

Figure 2:
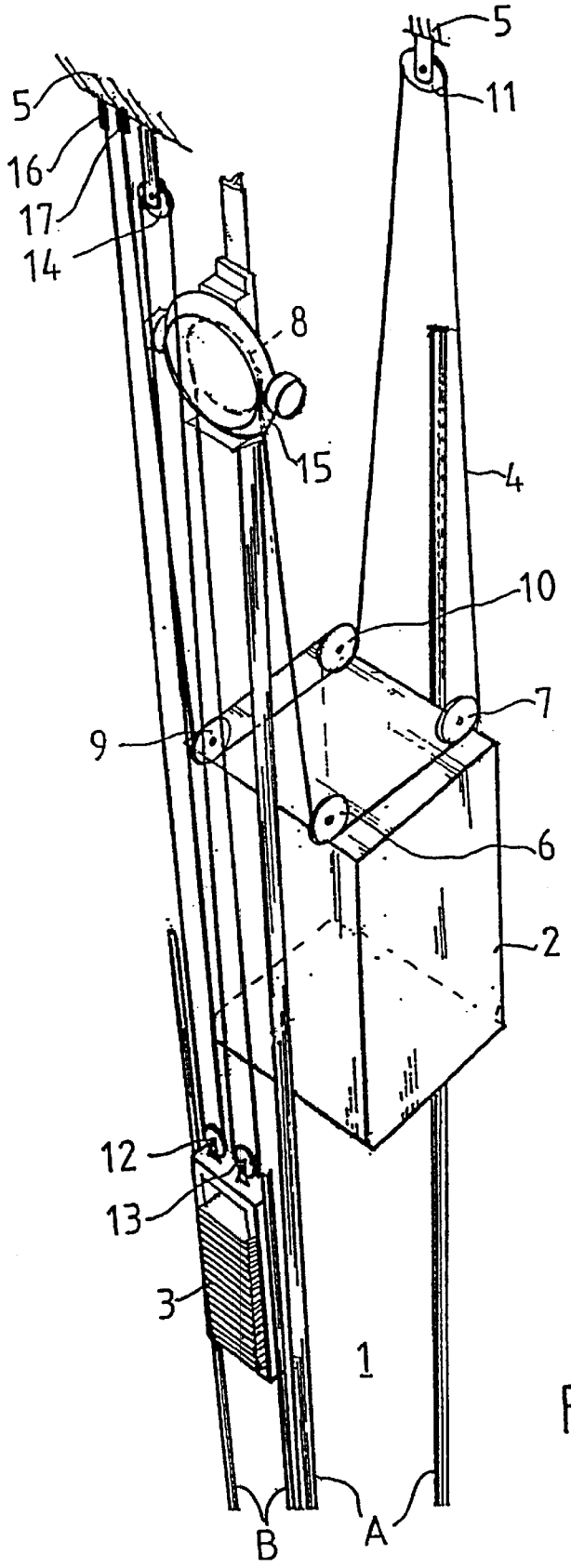
FIG. 2 presents a diagram representing a second embodiment of the traction sheave elevator of the invention, seen in perspective view obliquely from above.

In the embodiment illustrated by FIG. 2, the only difference as compared with the embodiment in FIG. 1 is that the first pair of car rope pulleys 6, 7 and the second pair of car rope pulleys 9, 10 are disposed on the top side of the elevator car 2. The rope 4 is therefore passed twice by the top side of the elevator car 2 and the elevator car 2 is suspended from the rope.

Referring further to FIG. 1, the counterweight 3 is provided with a first counterweight rope pulley 12 and a second counterweight rope pulley 13, which are connected to the counterweight so that their planes of rotation are substantially in the same vertical plane, in other words, so that the axes of rotation of the pulleys 12 and 13 are parallel. to each other. Connected to a fixed overhead structure 5 at about the same plane with the counterweight 3 is a second auxiliary rope pulley 14. The rope 4 is passed from the first counterweight rope pulley 12 via the second auxiliary rope pulley 14 to the second counterweight rope pulley 13. The speed ratio between the elevator car 2 and the counterweight 3 is thus 1:1.

In the embodiments in FIGS. 1 and 2, the first end 16 of the rope 4 is attached to a fixed. overhead structure 5 in the upper part of the elevator shaft 1. From the fixed overhead structure 5, the rope 4 is passed via the first counterweight rope pulley 12 to the second auxiliary rope pulley 14. Via the second auxiliary rope pulley 14, the rope is passed to the second counterweight rope pulley 13 and via it further over the rope pulley 8 of the traction motor 15 via the rope pulleys of the first pair of car rope pulleys 6, 7 and over the first auxiliary rope pulley 11 via the rope pulleys of the second pair of car rope pulleys 9, 10 to the fixed overhead structure 5, to which the second end 17 of the rope 4 is attached.

In some elevators, when the elevator is being loaded with heavy cargo or for other reasons, it may be necessary to prevent rope movement between the rope loops supporting the elevator car. Rope movement during loading can be prevented by using a brake acting on the rope or on a rope pulley mounted on the elevator car or on an auxiliary rope pulley 11. An advantageous stabilisation of the elevator car, effective even during operation, is achieved via appropriate placement of the drive machine. By placing the elevator drive machine together with the traction sheave in the position reserved for auxiliary rope pulley 11 in the embodiments in FIGS. 1 and 2, an advantageous configuration in respect of stability of the elevator car is achieved. In this case, the traction sheave, in which the friction between the rope and the rope grooves is often higher than in the other pulleys and in which the rotary motion driving or braking the elevator rope is dependent on the operation of the drive machine, functions as an element holding back the rope between the rope portions supporting the elevator car, i.e. between the rope portion going from the traction sheave towards the counterweight and the rope portion going from the traction sheave in the opposite direction relative to the length of the rope.

The invention is not restricted to the examples of its embodiments described above, but many variations are possible within the scope of the inventive idea defined by the claims.

What is claimed is:

1. A traction sheave elevator, comprising:

an elevator car adapted to move along a first guide track in an elevator shaft;

a counterweight adapted to move along a second guide track in the elevator shaft;

a rope, having first and second ends, wherein both ends are attached to a fixed overhead structure in upper part of the elevator shaft, the elevator car and the counterweight being carried by said rope;

a plurality of rope pulleys adapted to receive the rope and connected to the counterweight, a fixed overhead structure in the elevator shaft, and the elevator car, wherein the plurality of rope pulleys comprises:

a traction sheave;

a first pair of car rope pulleys mounted on the elevator car at a first distance from each other;

a second pair of car rope pulleys mounted on the elevator car at a second distance from each other; and an auxiliary rope pulley connected to the fixed overhead structure, wherein a rope is passed from one of the car rope pulleys of the first pair of car rope pulleys to one of the car rope pulleys of the second pair of car rope pulleys by way of the auxiliary rope pulley; and a traction motor arranged to drive the traction sheave.

2. The traction sheave elevator of claim 1, wherein the second pair of car rope pulleys is at a third distance from the first pair of car rope pulleys so that the rope portion passing via the first pair of car rope pulleys is substantially parallel to the rope portion passing via the second pair of car rope pulleys.

3. The traction sheave elevator of claim 2, wherein the first pair of car rope pulleys and the second pair of car rope pulleys are symmetrically disposed on either side of the a center line of the elevator car.

4. A traction sheave elevator, comprising:

an elevator car adapted to move along a first guide track in an elevator shaft;

a counterweight, adapted to move along a second guide track in the elevator shaft;

a rope, having first and second ends, wherein both ends are attached to a fixed overhead structure in upper part of the elevator shaft, the elevator car and the counterweight being carried by said rope;

a plurality of rope pulleys adapted to receive the rope and connected to the counterweight, a fixed overhead structure in the elevator shaft, and the elevator car, wherein the plurality of rope pulleys comprises:

a traction sheave, a first pair of car rope pulleys mounted on the elevator car at a first distance from each other, a second pair of car rope pulleys mounted on the elevator car at a second distance from each other, and an auxiliary rope pulley connected to the fixed overhead structure, wherein a rope is passed from one of the car rope pulleys of the first pair of car rope pulleys to one of the car rope pulleys of the second pair of car rope pulleys by way of the auxiliary rope pulley; and a traction motor arranged to drive the traction sheave;

a first counterweight rope pulley and a second counterweight rope pulley, both connected to the counterweight; and a second auxiliary rope pulley mounted on the fixed overhead structure directly above the counterweight wherein the rope passed from the first counterweight rope pulley to the second counterweight rope pulley via the second auxiliary rope pulley.

5. The traction sheave elevator of claim 1, wherein the first pair of car rope pulleys and the second pair of car rope pulleys are disposed under the elevator car, the rope being thus passed by a route below the elevator car.

6. The traction sheave elevator of claim 1, wherein the first pair of car rope pulleys and the second pair of car rope pulleys are disposed on top of the elevator car, in which case the rope is passed by the top side of the elevator car.

7. The traction sheave elevator of claim 4, wherein the rope is passed from the fixed overhead structure via the first counterweight rope pulley to the second auxiliary rope pulley and further to the second counterweight rope pulley and from there further to the traction sheave of the traction motor, from which the rope is further passed via the car rope pulleys of the first pair of car rope pulleys to the first auxiliary rope pulley and from there further via the car rope pulleys of the second pair of car rope pulleys to the fixed overhead structure.

8. The traction sheave elevator of claim 1, wherein the speed ratio between the elevator car and the counterweight is 1:1.

9. The traction sheave elevator of claim 1, wherein the first end of the rope, the second end of the rope, the first auxiliary rope pulley, the second auxiliary rope pulley, and/or the traction motor are mounted on guide rails.

10. The traction sheave elevator of claim 1, wherein the first and second guide rails are planted on the bottom of the elevator shaft to pass vertical forces down to groundwork.

* * * * *